US006428456B1

(12) United States Patent
Visona' et al.

(10) Patent No.: US 6,428,456 B1
(45) Date of Patent: Aug. 6, 2002

(54) APPARATUS FOR FORMING TUBULAR CONTAINERS WITH REINFORCED EDGES AND CONTAINER

(75) Inventors: Sergio Visona', Chiuppano; Giorgio Trani, Venice, both of (IT); Marion Sterner, Rosenheim (DE)

(73) Assignee: BP EUROPACK S.p.A., Lugo de Vincenza (IT)

( * ) Notice: Subject to any disclaimer, the term of this patent is extended or adjusted under 35 U.S.C. 154(b) by 0 days.

(21) Appl. No.: 09/601,206

(22) PCT Filed: Jan. 27, 1999

(86) PCT No.: PCT/EP99/00515

§ 371 (c)(1),
(2), (4) Date: Jul. 28, 2000

(87) PCT Pub. No.: WO99/38677

PCT Pub. Date: Aug. 5, 1999

(30) Foreign Application Priority Data

Jan. 30, 1998 (IT) ..... VE98A0004

(51) Int. Cl.[7] ..... B31B 1/64
(52) U.S. Cl. ..... 493/133; 493/129
(58) Field of Search ..... 53/459, 371, 551, 53/570, 552, 451; 493/129, 133, 156, 116, 117, 183, 904, 111

(56) References Cited

U.S. PATENT DOCUMENTS

| | | | | | |
|---|---|---|---|---|---|
| 4,041,851 | A | * | 8/1977 | Jentsch | 493/200 |
| 4,406,646 | A | * | 9/1983 | Jentsch | 493/209 |
| 4,685,276 | A | * | 8/1987 | Kiel | 53/459 |
| 5,862,652 | A | * | 1/1999 | Schoeler | 53/551 |

FOREIGN PATENT DOCUMENTS

| | | |
|---|---|---|
| EP | A-0 729 886 | 9/1996 |
| EP | A-0 769 367 | 4/1997 |

* cited by examiner

*Primary Examiner*—Scott A. Smith
*Assistant Examiner*—Chukwurah Nathaniel
(74) *Attorney, Agent, or Firm*—M. Lawrence Oliverio

(57) ABSTRACT

An apparatus for forming containers with reinforced edges, comprising:

a roll for feeding a flexible film;

a forming collar upstream of a first tube around which the film is wrapped;

a device for heat-sealing the longitudinal flaps of the film wrapped around the tube so as to form an enclosure, wherein the first tube tapers into a second tube and at the tapering region there is provided at least one insertion element which acts at right angles to the surface of the film, so as to form at least one rib which is directed toward the inside of the enclosure, and further comprising a sealing device for at least partially heat-sealing the at least one rib.

13 Claims, 3 Drawing Sheets

APPARATUS FOR FORMING TUBULAR CONTAINERS WITH REINFORCED EDGES AND CONTAINER

CROSS-REFERENCE TO RELATED APPLICATIONS

This application is a continuation of application number PCT/EP99/00515 filed on Jan. 27, 1999.

BACKGROUND OF THE INVENTION

The present invention relates to an apparatus for forming tubular containers with reinforced edges and to a container obtained with the apparatus.

Apparatuses for forming tubular containers with reinforced edges are known. For example, European patent 0 627 355 discloses an apparatus which comprises a square tube around which a flexible film, taken from a reel and guided along a forming collar, is wrapped.

Tabs are provided at the outer edges of the tube and form, on the film wrapped around the tube, V-shaped protruding flaps which are then joined at the facing surfaces by suitable heat-sealing bars.

Bags formed with these devices, however, suffer some drawbacks and particularly:

- an unpleasant aesthetic appearance, owing to the presence of the exposed flaps;
- bulk during transport;
- insufficient stability, since the sides can bend and therefore cause the bag to collapse;
- the impossibility to form designs thereon with continuity;
- an insufficient protection for the product contained therein, since the upper part is generally shaped like a sloping roof.

Patent DE 19539832 discloses a method for manufacturing bags with reinforced edges starting from a film in which a plurality of heat-sealed folds are formed before wrapping it around the forming tube. Bags with an internal ridge or bags with an external ridge are obtained according to such method, depending on how the film is wrapped around the tube.

A drawback of this method is the great storage volume necessary for the flexible film, since the folds considerably increase the thickness of the roll, together with difficulty in operation for the packaging unit, which has to wrap onto the forming collar, a material which is not perfectly smooth.

If the fold-forming step is performed between the step for unwinding the smooth film from the roll and the step for wrapping it onto the forming collar, there is still the drawback of the excessive bulk of said apparatus.

EP-0729886 A1 discloses a tubular bag-making machine as defined in the preamble of claim 1.

SUMMARY OF THE INVENTION

The aim of the invention is to eliminate these drawbacks and to provide an apparatus for forming containers with reinforced edges which has a modest storage volume.

An object of the invention is to provide an apparatus which allows to produce a package which is monolithic yet has the physical and functional characteristics of packages composed of a plurality of elements (cardboard+composite element).

A further object of the invention is to provide an apparatus which allows to produce containers which are substantially shaped like a parallelepiped, said shape being suitable for products which do not have a shape of their own (for example granular loose products).

This aim, these objects and others which will become apparent hereinafter are achieved, according to the invention, with an apparatus for forming containers with reinforced edges, as defined in claim 1.

BRIEF DESCRIPTION OF THE DRAWINGS

The present invention is described in greater detail hereinafter in a preferred practical embodiment thereof, given merely by way of non-limitative example with reference to the accompanying drawings, wherein.

DESCRIPTION OF THE PREFERRED EMBODIMENT

Figure 1:
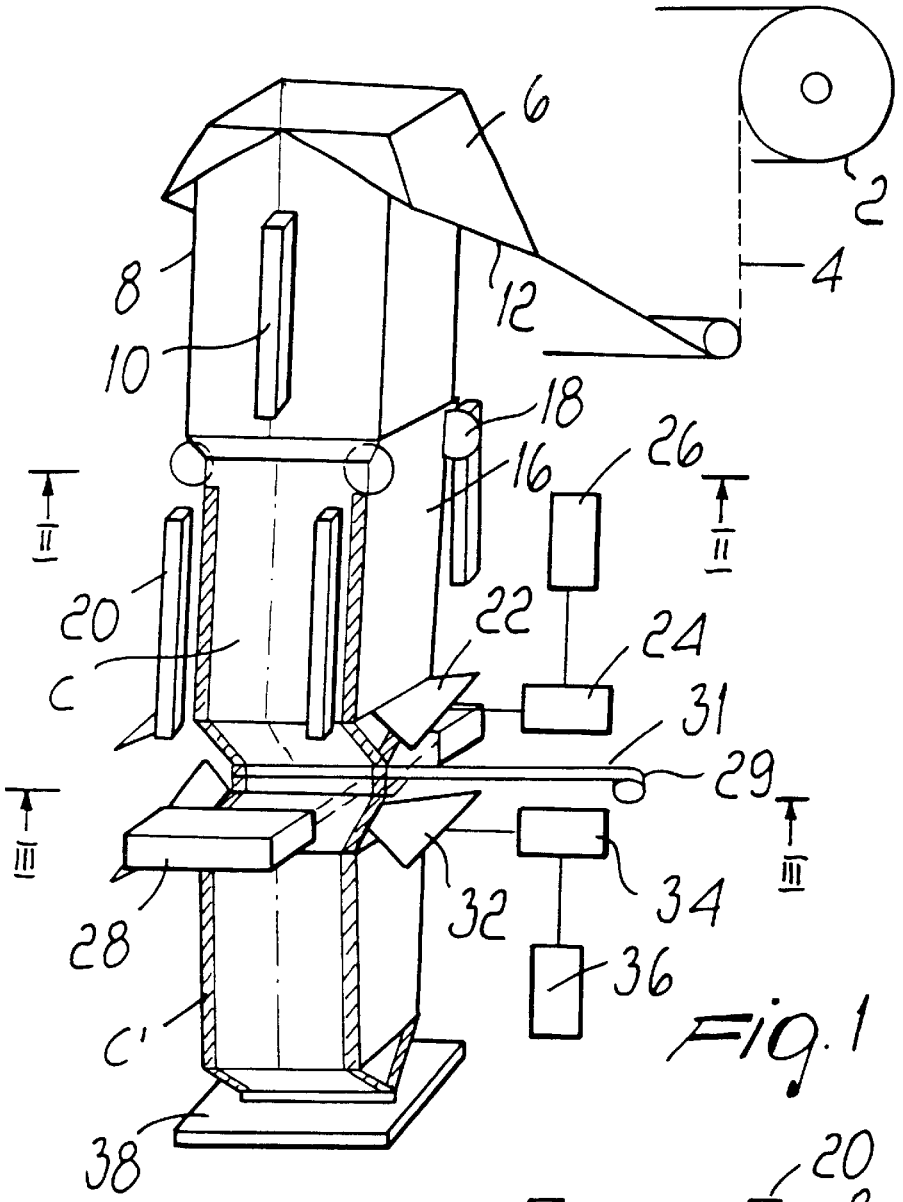
FIG. 1 is a schematic perspective view of an apparatus according to the invention.
Figure 2:
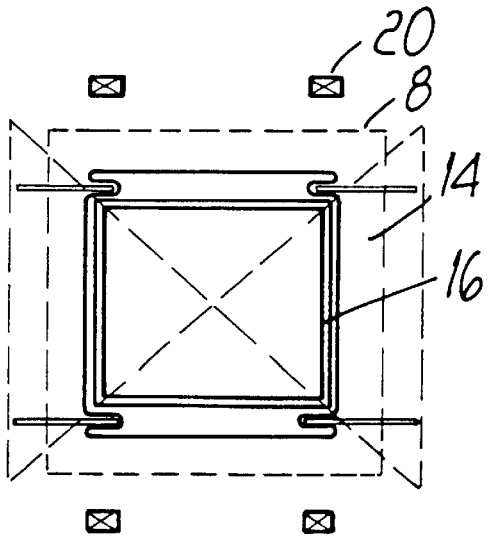
FIG. 2 is a schematic sectional view of the apparatus, taken along he transverse plane II—II of FIG. 1.
Figure 3:
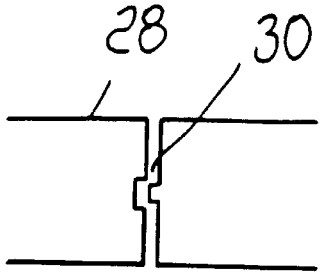
FIG. 3 is a schematic sectional view of the apparatus, taken along the plane III—III of FIG. 1.
Figure 4:
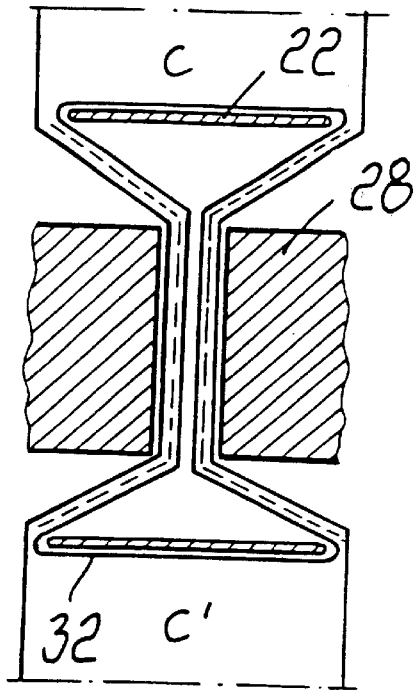
FIGS. 4–8 are schematic views of the apparatus during its operation.
Figure 5:
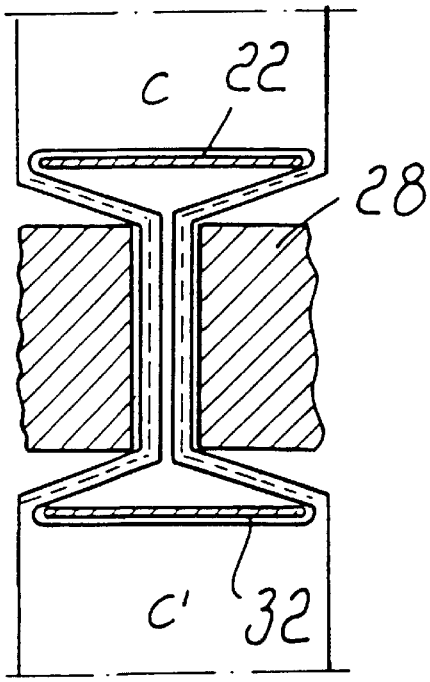
Figure 6:
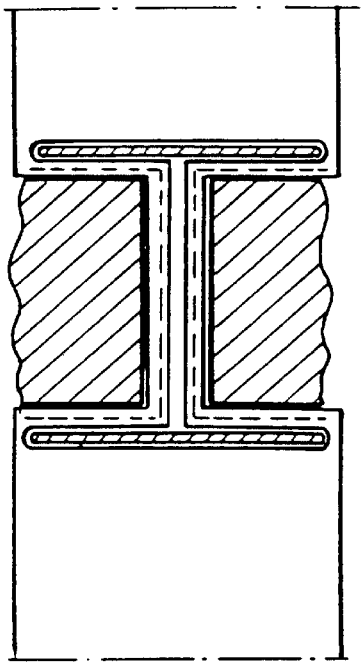
Figure 7:
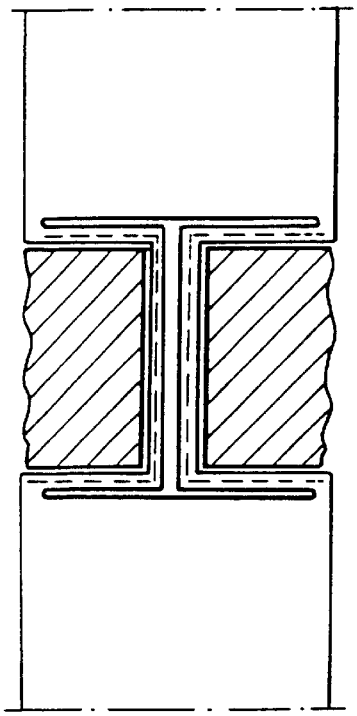
Figure 8:
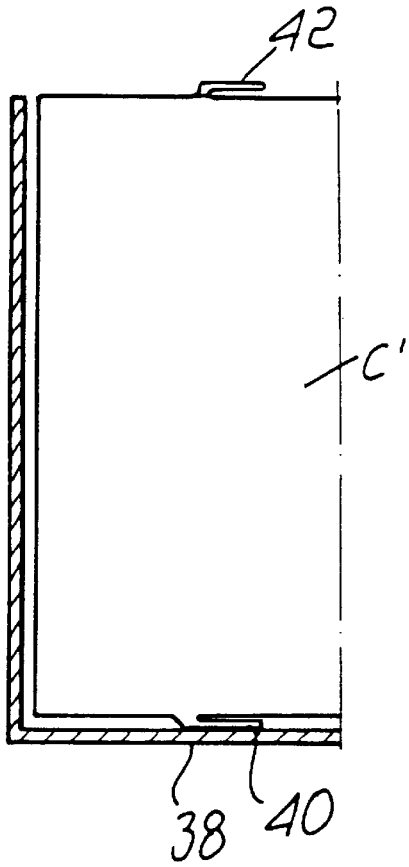

As shown in the Figures, the apparatus according to the invention is installed downstream of the filler tube of a conventional tube-type forming machine. The forming machine comprises a roll 2 for feeding a plastic flexible film 4 (for example polypropylene) and a forming collar 6 arranged above a tube 8 which has a rectangular cross-section and faces a vertically arranged bar 10 for heat-sealing the flaps 12 of the film. In other cases it is possible to provide tubes having a circular cross-section or any other polygonal cross-section.

The tube 8 is connected, by means of a portion 14 substantially shaped like a truncated pyramid, to a second rectangular tube 16 whose cross-section is smaller than that of the tube 8.

In particular, the difference between the perimeters of the two tubes 8 and 16 corresponds to twice the sum of the depth of the four ribs to be formed in the container.

At said truncated-pyramid portion 14, and more particularly at the edges thereof, there are provided four insertion elements 18 which are shaped like a wheel with a horizontal axis and are arranged in pairs so as to be mutually aligned and parallel to the two sides of the two tubes 8 and 16; their facing edges are mutually spaced by an extent which is shorter than the side of the tube 16.

Four vertical heat-sealing devices 20 face the tube 16, substantially at the edges, and have working surfaces whose width corresponds to the extent of the end portion of the insertion element which faces the side of the tube 16. At least one of the heat-sealing devices is provided, on its heat-sealing surface, with minute protrusions which form a weaker region in the container being formed; said weaker region cooperates with a band which is formed beforehand in the film and provides a pre-fracture region when the container is finished.

In particular, said heat-sealing devices are of any of the induction, impulse, hot-air, radio frequency, ultrasound and laser types.

At the heat-sealing device 28 there is a device 29 for feeding a plastic tape 31 whose function will become apparent hereinafter.

At the lower end of the tube 16 two mutually opposite additional triangular insertion elements 22 are provided, the tip of which acts substantially at right angles to the walls of the tube. Said insertion elements are mounted at the ends of two rods which can move axially under the actuation of pneumatic devices 24 which can in turn move vertically under the actuation of pneumatic devices 26.

Other situations use jets of compressed air obtained by means of contoured nozzle.

Below said insertion elements a heat-sealing device 28 is provided which has a horizontal axis and is provided with a cutter 30 arranged transversely to the advancement direction of the band.

Below the heat-sealing device two additional mutually opposite triangular insertion elements 32 are provided which lie on a horizontal plane which is parallel to the insertion elements 22. Said insertion elements 32 are mounted at the ends of two rods which can move axially under the actuation of the pneumatic devices 34, which in turn can move vertically under the actuation of the pneumatic devices 36.

Finally, there is a heated supporting ledge 38 which acts as a stroke limiter for the packaged and filled container.

The apparatus further comprises a plurality of actuation elements (insertion elements, actuators), transmission elements, and automation devices (switches, counters, various controls, etcetera) which allow to perform the automatic production cycle. Some of these elements have not been illustrated and described for the sake of simplicity in interpretation, but are in any case referenced in the following description of the operation of the apparatus by mentioning their presence, since they are of a conventional type and as such are known to the expert in the field.

Figure 10:
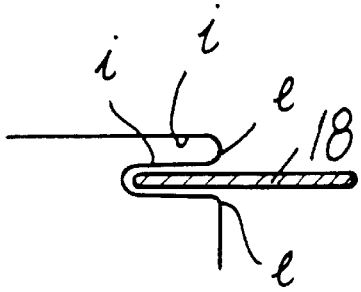
FIG. 10 is an enlarged-scale view of a detail of the ribs formed on the container.

The operation of the apparatus according to the invention is as follows:

the flexible film 4 is unwound from the roll 2, is drawn along the forming collar 6, and is then wrapped around the tube 8 so as to form an enclosure which is closed at the flaps 12 by the heat-sealing device 10. As the closed enclosure thus formed passes from the tube 8 through the portion 14 so as to arrange itself around the tube 16, the ends of the insertion elements 18 form, at the edges of the enclosure, a series of folds (ribs) which are constituted by the overlap of three portions of film (see FIG. 10) in which part of an inner side (i) is faced with another part of the inner side (i) and a part of an outer side (e) is faced with another part of the outer side (e).

The resulting folds are then heat-sealed by the heat-sealing devices 20, so as to obtain an enclosure 21 which has a rectangular shape in plan view, with reinforced edges 23 which are directed inward.

It should be observed that during the heat-sealing of the horizontal bands, the ends of the tape 31 fed by the feeder 29 are also heat-sealed to the container, thus forming a sort of handle on the container.

In order to join materials which do not have the necessary joining properties, said band is already pretreated on the outer side with the addition of a localized spreading of primers or thermal bonding lacquers, of the peelable type if required, at the regions that will become the edges of the container. These treatments can be performed "on-line" with the aid of suitable equipment.

When the ends of the enclosure being formed protrude from the tube 16, the apparatus according to the invention carries out the following steps:

a) protrusion of the stems of the pneumatic devices 24, 34, which cause the advancement of the insertion elements 22, 32 toward the enclosure so as to form respective folds on two facing vertical walls of the container;

b) intervention of the heat-sealing device 28 to heat-seal the region interposed between the two pairs of insertion elements 22 and 32 and intervention of the cutter 30 to simultaneously form the bottom of the container C and close the contiguous container C' in an upper region;

c) advancement of the tubular band by a short extent;

d) simultaneous descent of the pair of upper insertion elements 22, so as to flatten the bottom of the container against the upper horizontal surface of the heat-sealing device 28, which thus heat-seals the folded flaps of the container so that an inner part faces an inner part (see FIGS. 4–7);

e) simultaneous upward motion of the ledge 38 against the bottom of the container C'; this upward motion simultaneously causes the heat-sealing of the outer surfaces of the container against the heat-sealing device 28 and the heat-sealing of the fin 40, which was formed during the previous cycle during cropping, to the outer lower surface of the container C';

f) simultaneous upward movement of the insertion elements 32 toward the heat-sealing device 28, so as to rest the flaps against it and heat-seal the mutually facing internal surfaces of the container;

g) heat-sealing of the bottom of the container at the outer surfaces of the coupled flaps;

h) retraction of the stems into the pneumatic devices 24, so as to disengage the insertion elements 22 from the container;

i) simultaneous retraction of the stems into the pneumatic devices 34 so as to disengage the insertion elements 32 from the container;

j) insertion of the product (in any condition) in the formed enclosure through the upper end of the tube 8;

k) opening of the bars 10,20 so as to disengage the two containers C, C';

l) downward motion of the ledge that supports the container. C' thus produced and filled with the product;

m) simultaneous return of the two pairs of mutually opposite insertion elements 22 and 32 to the initial position to begin step a) of the next cycle;

n) intervention of a nozzle which causes the upper fin 42 to arrange itself adjacent to the outer surface of the bag, said fin heat-sealing itself to the surface of said bag because it is still hot;

o) unloading of the bag from the ledge 38 by means of an air jet.

Figure 9:
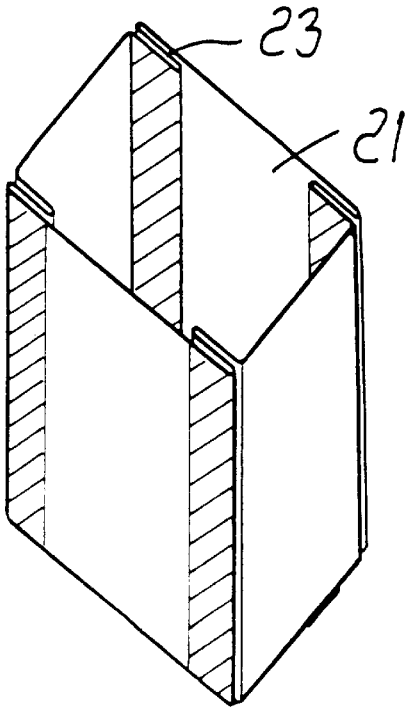
FIG. 9 is a partially sectional perspective view of a container obtained with the apparatus.

From the above description it is evident that the apparatus according to the invention achieves several advantages and in particular allows to produce containers with reinforced edges, since the resulting edges are both heat-sealed together by melting the external heat-sealing layer of the band (an outer face against an outer face) and are heat-sealed on one side against a face of the container, so as to rigidly fix the ridge to one face of the enclosure (an inner face against an inner face), so as to give the final container a higher rigidity characteristic (see FIG. 9).

The present invention has been illustrated and described in a preferred practical embodiment thereof, but it is understood that other constructive variations may in practice be applied thereto without however abandoning the scope of the protection of the present industrial invention patent.

The disclosures in Italian Patent Application No. VE98A00004 from which this application claims priority are incorporated herein by reference.

What is claimed is:

1. An apparatus for forming containers with reinforced edges, comprising:

a roll for feeding a flexible film;

a forming collar upstream of a first tube around which the film is wrapped;

a device for heat-sealing the longitudinal flaps of the film wrapped around the tube so as to form an enclosure, the first tube tapering into a second tube and at the tapering region at least one insertion element acting at right angles to the surface of the film, so as to form at least one rib which is directed toward the inside of the enclosure, a sealing device for at least partially heat-sealing said at least one rib being also provided, said at least one rib being formed by an odd number of overlapped heat-sealed portions of said film, said odd number being at least three;

the difference between the perimeter length of the two tubes being equal to twice the sum of the depth of the ribs to be obtained.

2. The apparatus according to claim 1, wherein the tubes have a polygonal cross-section.

3. The apparatus according to claim 1, wherein the tubes have a rectangular cross-section.

4. The apparatus according to claim 1, wherein the tubes have a circular cross-section.

5. The apparatus according to claim 1, wherein the at least one insertion element is constituted by a wheel having a horizontal axis.

6. The apparatus according to claim 1, comprising, downstream of the second tube:

at least one pair of triangular insertion elements for forming, on the enclosure, corresponding folds which constitute the bottom and the top of said enclosure, said insertion elements being movable towards and away from two facing surfaces of the enclosure and being further movable at right angles with respect to the movement direction toward the two surfaces;

an element for heat-sealing the transverse flaps of the enclosure;

a ledge for supporting the bottom of the formed enclosure.

7. The apparatus according to claim 6, wherein the heat-sealing element is provided with a cutter.

8. The apparatus according to claim 6, wherein the insertion elements are mounted at the ends of stems of hydraulic jacks which have a horizontal axis and are in turn mounted at the ends of hydraulic jacks having a vertical axis.

9. The apparatus according to claim 6, further comprising, at the heat-sealing element, a device for feeding a plastic tape.

10. A container made of heat-sealable flexible film material, said container having a longitudinal tubular extension with a polygonal cross-section perpendicular to the longitudinal tubular extension, said container comprising a plurality of longitudinal heat-sealed ribs which are directed toward the inside of the container and which are arranged at the angles of the polygonal cross-section of the container and which extend in a direction of said longitudinal extension, said longitudinal heat-sealed ribs being formed by at least three heat-sealed folded overlapping portions of said film material, and said container having a smooth outer surface void of protruding portions of said film material.

11. The container of claim 10, wherein said polygonal cross-section is rectangular.

12. An apparatus for forming containers with reinforced edges, comprising:

a roll for feeding a flexible film;

a forming collar upstream of a first tube around which the film is wrapped;

a device for heat-sealing the longitudinal flaps of the film wrapped around the tube so as to form an enclosure, the first tube tapering into a second tube and at the tapering region at least one insertion element acting at right angles to the surface of the film, so as to form at least one rib which is directed toward the inside of the enclosure, a sealing device for at least partially heat-sealing said at least one rib being also provided, said at least one rib being formed by an odd number of overlapped heat-sealed portions of said film, said odd number being at least three, and said second tube having a smooth outer surface being void of protrusions protruding radially from said smooth outer surface whereby the enclosure sliding and being formed on the smooth outer surface of said second tube.

13. The apparatus of claim 12, wherein said second tube having a polygonal cross-section perpendicular to the longitudinal extension of said second tube, and said at least one insertion element being arranged to form said at least one rib at the angles of the polygonal cross-section of said second tube.

* * * * *